US009105457B2

(12) United States Patent
Badiei et al.

(10) Patent No.: US 9,105,457 B2
(45) Date of Patent: Aug. 11, 2015

(54) CONE-SHAPED ORIFICE ARRANGEMENT FOR INDUCTIVELY COUPLED PLASMA SAMPLE INTRODUCTION SYSTEM

(75) Inventors: Hamid R. Badiei, Woodbridge (CA); Dmitry Bandura, Aurora (CA); Vladimir Baranov, Richmond Hill (CA); Kaveh Kahen, Maple (CA); Scott Tanner, Aurora (CA)

(73) Assignee: PerkinElmer Health Sciences, Inc., Waltham, MA (US)

( * ) Notice: Subject to any disclaimer, the term of this patent is extended or adjusted under 35 U.S.C. 154(b) by 0 days.

(21) Appl. No.: 13/033,256

(22) Filed: Feb. 23, 2011

(65) Prior Publication Data

US 2011/0253888 A1 Oct. 20, 2011

Related U.S. Application Data

(60) Provisional application No. 61/307,737, filed on Feb. 24, 2010.

(51) Int. Cl.
*H01J 49/00* (2006.01)
*H01J 49/10* (2006.01)

(52) U.S. Cl.
CPC ..... *H01J 49/105* (2013.01)

(58) Field of Classification Search
CPC ..... H01J 49/067
USPC ..... 250/281, 282, 283, 284, 288, 289
See application file for complete search history.

(56) References Cited

U.S. PATENT DOCUMENTS 4,160,161 A * 7/1979 Horton ..... 250/281
4,682,026 A * 7/1987 Douglas ..... 250/288
4,740,696 A * 4/1988 Osawa et al. ..... 250/288
4,863,491 A * 9/1989 Brandt et al. ..... 95/29
5,148,021 A * 9/1992 Okamoto et al. ..... 250/288
5,283,199 A * 2/1994 Bacon et al. ..... 436/173
5,367,163 A * 11/1994 Otsuka et al. ..... 250/288
5,383,019 A * 1/1995 Farrell et al. ..... 356/316
5,565,679 A * 10/1996 Tanner et al. ..... 250/288
5,614,711 A * 3/1997 Li et al. ..... 250/287

(Continued)

OTHER PUBLICATIONS

Bandura, et al, "Mass Cytometry: Technique for Real Time Single Cell Multitarget Immunoassay Based on Inductively Coupled Plasma Time-of-Flight Mass Spectrometry," Analytical Chemistry, vol. 81, No. 16, pp. 6813-6822, Aug. 15, 2009.

(Continued)

*Primary Examiner* — Michael Logie
*Assistant Examiner* — Jason McCormack
(74) *Attorney, Agent, or Firm* — Ropes & Gray LLP

(57) ABSTRACT

A mass analysis system including a sample inlet arranged to introduce a sample and an ion source coupled to the sample inlet and arranged to ionize a portion of the sample into ions. The system also includes a sampler element having a sample orifice arranged to receive the sample ions into a first vacuum chamber. The system includes a skimmer element having a skimmer orifice arranged to receive the sample ions from the first vacuum chamber into a second vacuum chamber where the skimmer orifice is of a first size. The system further includes a third cone element having a third cone orifice of a second size arranged to receive the sample ions from the second vacuum chamber into a third vacuum chamber where the third cone is configured to allow a continuum flow of ions through the third cone orifice. The third chamber includes an ion optics assembly and mass analyzer.

26 Claims, 6 Drawing Sheets

(56) References Cited

U.S. PATENT DOCUMENTS

| | | | | |
|---|---|---|---|---|
| 5,747,799 | A * | 5/1998 | Franzen | 250/288 |
| 5,770,857 | A * | 6/1998 | Fuerstenau et al. | 250/281 |
| 6,015,972 | A * | 1/2000 | Hager | 250/282 |
| 6,229,142 | B1 * | 5/2001 | Bateman et al. | 250/287 |
| 6,627,877 | B1 * | 9/2003 | Davis et al. | 250/287 |
| 6,903,334 | B1 * | 6/2005 | Makarov et al. | 250/288 |
| 7,176,455 | B1 * | 2/2007 | Whitehouse et al. | 250/288 |
| 2001/0038069 | A1 * | 11/2001 | Whitehouse et al. | 250/288 |
| 2004/0011955 | A1 * | 1/2004 | Hirano et al. | 250/288 |
| 2004/0149900 | A1 * | 8/2004 | Makarov et al. | 250/287 |
| 2004/0159784 | A1 * | 8/2004 | Doroshenko et al. | 250/288 |
| 2004/0262512 | A1 * | 12/2004 | Tobita et al. | 250/288 |
| 2005/0151074 | A1 * | 7/2005 | Thakur | 250/288 |
| 2006/0151689 | A1 * | 7/2006 | Bateman | 250/288 |
| 2010/0096556 | A1 * | 4/2010 | Arsalan et al. | 250/370.07 |

OTHER PUBLICATIONS

Sturgeon et al, "Analytical characteristics of a commercial ICP orthogonal acceleration time-of-flight mass spectrometer (ICP-TOFMS)," J. Anal. St. Spectrom, 2000, 16, pp. 607-616, Published on the Web Apr. 28, 2000.

Turner, P.J., "Applications of Plasma Source Mass Spectrometr". ed. G. Holland, A. N. Eaton, Royal Society of Chemistry, Cambridge, U.K., 1991, pp. 71-78).

Praphairaksit et al, "Reduction of Space Charge Effects in Inductively Coupled Plasma Mass Spectrometry Using a Supplemental Electron Source inside the Skimmer: Ion Transmission Mass Spectral Characteristics," Analytical Chemistry, vol. 72, No. 11, Jun. 1, 2000.

Tanner et al, "Gas and Ion Dynamics of a Three-Aperture Vacuum Interface for Inductively Coupled Plasma-Mass Spectrometry," Applied Apectroscopy, vol. 48, No. 11, Received Jun. 8, 1993; Accepted Aug. 25, 1994.

* cited by examiner

600

CONE-SHAPED ORIFICE ARRANGEMENT FOR INDUCTIVELY COUPLED PLASMA SAMPLE INTRODUCTION SYSTEM

REFERENCE TO RELATED APPLICATIONS

This application claims the benefit of U.S. Provisional Application No. 61/307,737 filed Feb. 24, 2010 and entitled "Inductively Coupled Plasma Mass Spectrometer," the entirety of which is incorporated herein by reference.

INTRODUCTION

Trace elemental composition of samples is commonly determined by aspirating the sample aerosol into an ionization source such as an inductively coupled plasma (ICP) ionization source and sampling the ions into a mass analyzer such as a mass spectrometer (MS). Optical methods that measure the emission intensity of the ionic and atomic species are also common but the detection limits are generally inferior to ICP-MS.

Despite its excellent analytical performance characteristics, argon ICP-MS is susceptible to space-charge-induced matrix interferences due to a relatively intense ion beam that is dominated by $Ar^+$. The space charge effects are considered significant in the MS interface area which commonly comprises of two ~1 mm cones, namely sampler and skimmer. The space charge effects are dominant primarily downstream of the skimmer orifice and ion optics. Due to their higher mobility, electrons diffuse out of the ion beam towards the inner wall of the skimmer cone as the ion beam passes through the orifice. The formation of a negatively charged electron sheath causes the positive ions to also diffuse away from the beam axis in order of their mobility. This results in a radial expansion of the ion flux with a net charge imbalance that has a self-defocusing characteristic.

The most severe matrix effects occur when signals from relatively light (low-mass) analytes are suppressed in presence of high concentrations of relatively heavy (high-mass) elements in the matrix. Plasma species (including ions) travel through a typical ICP-MS interface with essentially the same speed as that of the plasma gas (e.g., argon). Therefore, the kinetic energy of ions becomes directly mass-dependent and high-mass ions (having higher kinetic energies as compared to low-mass ions) will be more efficiently transmitted through the defocusing space charge field. This leads to undesirable mass bias in favor of high mass ions.

Problems arising in mass spectra as a result of space charge effects include, for example, mass discrimination in the analyte response (usually a bias against low-mass ions in favor of high-mass ions), matrix effects (suppression of analyte signals in presence of high concentrations of high-mass elements in the sample matrix) and errors in measured isotope ratios especially for low-mass isotopes.

Different approaches are taken by others, and disclosed through patents and publications, to reduce space charge effects. Tanner et al. (U.S. Pat. No. 5,381,008, and *Appl. Spectrosc.,* 1994, 48, 1373-1378) used a blunt reducer plate with an offset orifice (0.2 mm dia.) significantly smaller than the skimmer orifice to reduce ion current entering the downstream ion optics to reduce the space charge field.

P. J. Turner (in *Applications of Plasma Source Mass Spectrometry*; ed. G. Holland, A. N. Eaton, Royal Society of Chemistry, Cambridge, U.K., 1991, pp 71-78) described a method of acceleration of the ions by using relatively high bias potentials (−2000 V) behind the skimmer orifice to reduce ion density and consequently the space charge effect.

This approach may cause complications downstream the ion optics and may affect the mass spectrometer resolution and abundance sensitivity. In addition, the use of high voltages may cause electrical discharges that would lead to higher photon noise as well as extraction of easily ionizable species from the skimmer cone, resulting in elevated background equivalent concentration (BEC) for many elements such as Na and K.

Houk et al. (*Anal. Chem.,* 2000, 72, 2356-2361) utilized a heated filament (from an electron impact analyzer) behind the skimmer to supplement the ion beam with electrons and balance its excess positive charge in order to reduce ion space charge repulsion.

In addition to space-charge problems, inductively coupled plasma mass spectrometry has been limited to samples with total dissolved solids (TDS) less than 0.1-0.2%. Samples containing higher TDS require dilution prior to analysis in order to control signal suppression and salt build-up on the MS interface components. In addition to interface cones, downstream optical components are also prone to contamination when high-salt matrices are used with ICP-MS. Contaminated ion optical elements would otherwise cause significant drift in ion signal, low signal intensity, elevated background levels, and poor short-term and long-term precision.

Accordingly, there is a need to eliminate the adverse effects of space charge while reducing contamination and minimizing downtime of the ICP-MS system.

SUMMARY

The application, in various embodiments, addresses the deficiencies of current ICP-MS systems by providing systems and methods including a mass analysis system that uses a third cone configured to reduce the contamination of ion optics while minimizing potential adverse affects from space charges.

The system and methods described, inter alia, incorporate a mass analysis system including a sample inlet arranged to receive a sample, an ion source coupled to the sample inlet and arranged to ionize a portion of the sample into ions, a sampler element including a sampler orifice arranged to receive the ions into a first vacuum chamber, a skimmer element including a skimmer orifice arranged to pass the ions from the first vacuum chamber into a second vacuum chamber, and a third cone element including a third cone orifice arranged to pass the ions from the second vacuum chamber into a third vacuum chamber. The third vacuum chamber can include an ion optics assembly and a mass analyzer. The third cone orifice is configured to allow a flow of ions through the third cone orifice.

The third cone may have an angle between its two exterior sides as viewed in a cross-section of at least about 30 degrees (full angle). In certain embodiments, the third cone has an angle between its two exterior sides as viewed in a cross-section of about 40 degrees (full angle). In one aspect, the third cone forms a substantial sharp tip about the third cone orifice.

In one aspect, the third cone is biased at about ground potential. In another aspect, each orifice is substantially circular. In some aspects, the skimmer orifice has a first size and the third cone orifice has a second size, in which the first and second sizes are approximately equal. In one aspect, the mass spectrometer is selected from a quadrupole assembly, an ion trap, a magnetic sector analyzer, a time of flight analyzer, an ion mobility analyzer, or any combination thereof. In another aspect, the ion optics assembly includes at least one ion focusing element. In yet another aspect, the diameter of the third cone orifice is approximately 1 mm.

In one aspect, the pressure of the first chamber is approximately 1-5 Torr, the pressure of the second chamber is approximately 20-200 mTorr and the pressure of the third chamber is approximately $1\times10^{-3}$-$1\times10^{-6}$ Torr. In one aspect, the pressure of the second chamber is approximately 20-70 mTorr.

In one process, a method for analyzing a sample includes introducing a sample, ionizing a portion of the sample into ions, receiving the ions into a first vacuum chamber via a sampling orifice, receiving the ions from the first vacuum chamber into a second vacuum chamber via a skimmer orifice having a first size, and receiving the ions from the second vacuum chamber into a third vacuum chamber via a third cone orifice having a second size. The third vacuum chamber may include an ion optics assembly and a mass analyzer. In one aspect, the third cone is configured to allow for a continuum flow of ions through the third cone orifice.

These and other features of the applicant's teachings are set forth herein.

DRAWINGS

The foregoing and other objects and advantages of the invention will be appreciated more fully from the following further description thereof, with reference to the accompanying drawings. The skilled person in the art will understand that the drawings, described below, are for illustration purposes only. The drawings are not intended to limit the scope of the applicant's teaching in any way.

DESCRIPTION OF VARIOUS EMBODIMENTS

While the applicant's teachings are described in conjunction with various embodiments, it is not intended that the applicant's teachings be limited to such embodiments. On the contrary, the applicant's teachings encompass various alternatives, modifications, and equivalents, as will be appreciated by those of skill in the art. For example, the illustrated system is described with respect to an Inductively Coupled Plasma Mass Spectrometer (ICP-MS), however the systems and method described herein may be used in with any type of sample analysis system using any suitable type of ionizer or mass spectrometer.

Figure 1:
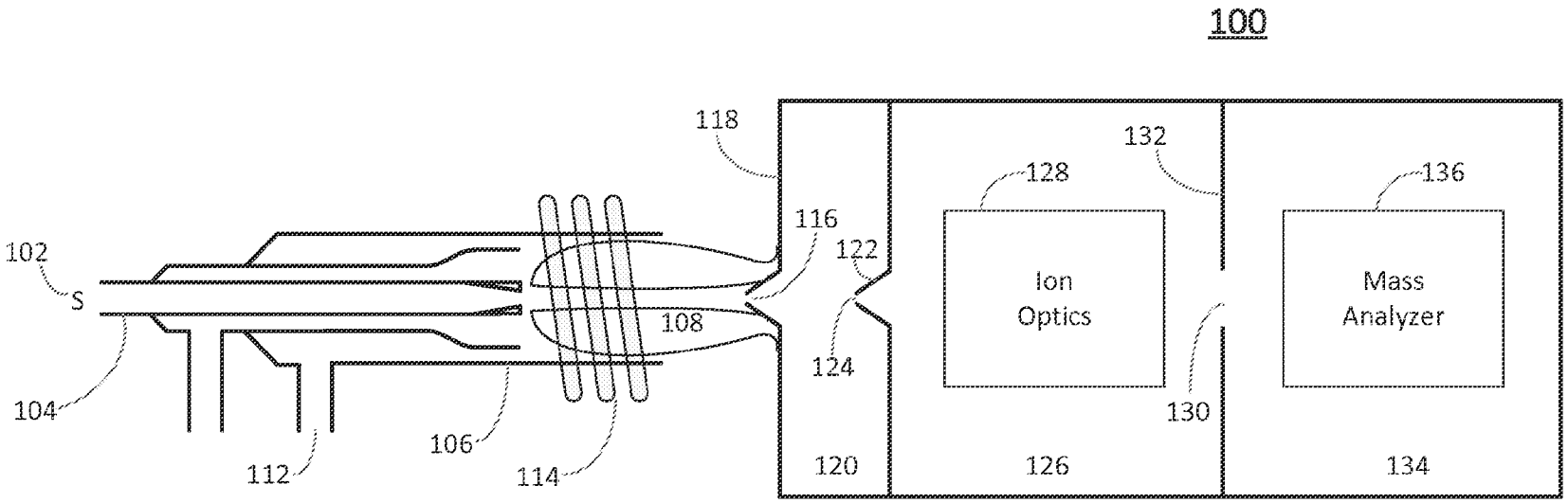
FIG. 1 shows a diagram of a mass analysis system including a multi-chamber arrangement.

FIG. 1 depicts a diagram of a mass analysis system 100 including a multi-chamber arrangement. System 100 includes a sample source 102, which supplies a sample contained in a carrier gas (e.g., argon) through a tube 104 into a quartz tube 106 which contains plasma 108. Outer tube 112 provides outer flows of argon from an argon source.

The plasma 108 is generated close to atmospheric pressure by an induction coil 114 encircling the quartz tube 106. Plasma 108 can also be generated in any other suitable fashion known in the art. The plasma 108 atomizes the sample stream 102 and ionizes the atoms, creating a mixture of ions and free electrons. A portion of the plasma 108 is sampled through an orifice 116 in a sampler 118 which forms a wall of a first vacuum chamber 120. Vacuum chamber 120 is evacuated to a moderately low pressure (e.g. 1-5 Torr) by a vacuum pump (not shown). In most cases, a mechanical pump is used to evacuate this stage. The first vacuum chamber 120 also includes a skimmer 122 having an orifice 124 which leads to a second vacuum chamber 126. The second vacuum chamber 126 is evacuated to a lower pressure (e.g., $10^{-3}$ Torr or less) than that of the first vacuum chamber 120. The second vacuum chamber 126 includes ion optics 128 for focusing the ion beam.

The ions emerging from the ion optics 128 travel through an orifice 130 in a wall 132 and into a third vacuum chamber 134. In certain embodiments, the third vacuum chamber may be part of the second chamber. The third vacuum chamber 134 includes a mass analyzer 136, which is typically a quadrupole mass spectrometer, but may be any other form of mass analyzer, e.g., an ion trap, a magnetic sector analyzer, a time of flight analyzer, an ion mobility analyzer, or any other suitable mass analyzer known to those of skill in the art.

In use, ions from the plasma 108 travel with the plasma gas through the sampler orifice 116. Ions then pass through the skimmer aperture 124, carried by the bulk gas flow. The ions are then charge separated, partly because of the diffusion of high mobility electrons and partly because of the ion optics 128 and the bias potentials thereon. The ions are focused by the ion optics 128 through orifice 130 and into the mass analyzer 136. The mass analyzer 136 is controlled to produce a mass spectrum for the sample being analyzed.

In system 100, the pressure in vacuum chamber 120 drops significantly from vacuum chamber 120 (approximately 1-5 Torr) to vacuum chamber 126 (approximately $10^{-3}$ Torr or less). As a result of this significant differential pressure existing across the skimmer orifice, the higher mobility electrons diffuse out of the ion beam toward the inner wall of the skimmer cone 122 as the ion beam passes through the skimmer orifice 124. As discussed above, the formation of a negatively charged electron sheath causes the positive ions to also diffuse away from the beam axis in order of their mobility. This results in a radial expansion of the ion flux with a net charge imbalance that has a self-defocusing characteristic (i.e., the space charge effect).

The ion beam travelling through the region between the skimmer orifice 124 and the ion optics 128 is affected by the space charge effect as the ions travel through the orifice 124. While a relatively large ion current is calculated to pass through the skimmer orifice 124, only a very small ion current is transmitted to the ion optics 128, in large part as a result of the space charge effects. Enhanced transmission of heavier ions further attenuates the transmission of lighter analyte ions. The space charge effect attenuates the ion current of lower mass ions more than that of higher mass ions, giving rise to discrimination against low masses. The resultant non-uniform response leads to greater difficulty in calibrating the instrument and in detecting low mass ions.

Figure 2:
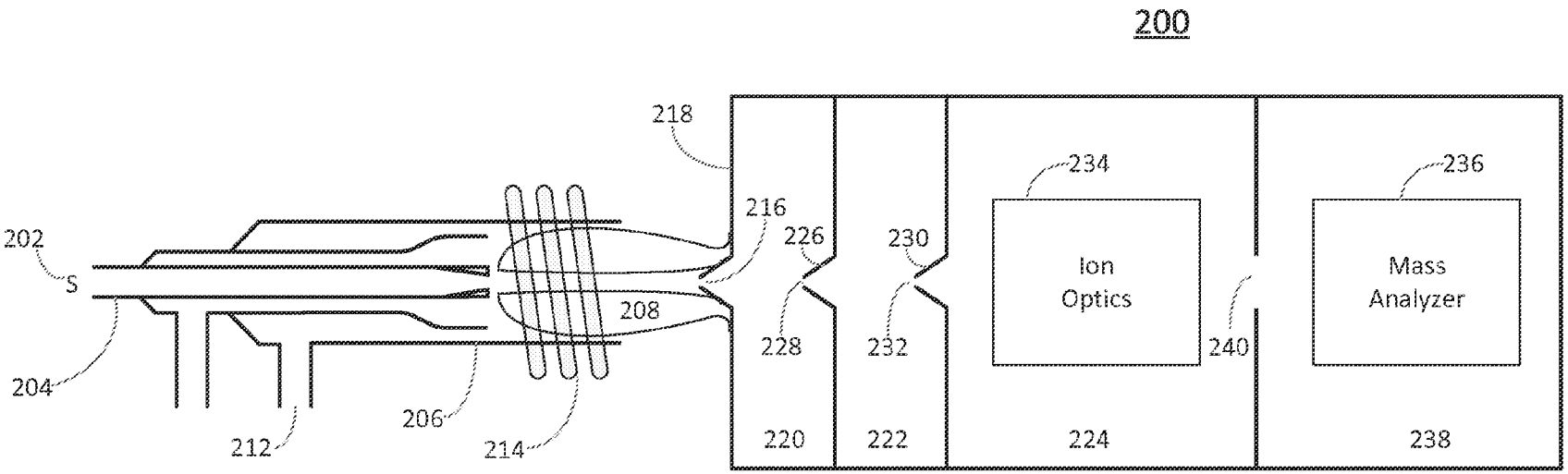
FIG. 2 shows a diagram of a mass analysis system including a multi-chamber arrangement with various orifices according to an illustrative embodiment of the invention.

FIG. 2 shows a diagram of a mass analysis system 200 including a multi-chamber arrangement with a three-aperture interface design that utilizes a third cone at ground potential, namely a third cone behind the skimmer cone, according to an illustrative embodiment. The third cone functions to, inter alia, transmit analyte ions to the downstream optics, suppress skimmer-produced ions, collimate particle trajectory and improve robustness to total dissolved solids (TDS), reduce overall gas load in the ion optics chambers, improve ion/gas ratio, and protect the downstream optics from contamination.

System 200 operates in a manner similar to system 100 and includes a sample source 202, a sample flow tube 204, a quartz tube 206 which contains plasma 208, outer tube 212 which provide outer flows of argon from an argon source, and induction coil 214 encircling the quartz tube 206. Similarly to system 100, a portion of the plasma 208, created in the quartz tube 206, is sampled through an orifice 216 in a sampler 218 and skimmed by a skimmer 226 having an orifice 228. However, system 200 differs from system 100 in that it includes an additional vacuum chamber, the second vacuum chamber 222 having a third cone 230 with orifice 232. In certain embodiments, the third cone 230 is held at ground potential which protects the skimmer 226 from downstream extraction fields that could otherwise extract and accelerate ions from the skimmer. The additional region of the vacuum chamber between the skimmer and the third cone, the second vacuum chamber 222, reduces the overall gas load entering the optics vacuum chamber 224 and relaxes pumping requirements. The third cone 230 acts as a secondary skimmer by eliminating high mobility species (i.e., electrons) and neutrals that undergo re-expansion at the skimmer.

The second region in the vacuum chamber 222, allows for a step-wise reduction in pressure in going from the atmospheric pressure quartz tube 206 to the ion optics vacuum chamber 224. For example, the first region of the vacuum chamber, 220 can be pumped to approximately 1-5 Torr (using a mechanical pump). The second region can be pumped to an intermediate pressure (e.g., approximately 20-200 mTorr), and in various aspects, 20-70 mTorr, while the ion optics vacuum chamber, the third vacuum chamber, 224 can be pumped to a low pressure (e.g., approximately $1\times10^{-3}$-$1\times10^{-6}$ Torr).

As discussed above, contaminated optics may cause signal drift, low signal intensity, elevated background levels and poor short-term and long term-precision. Additionally, frequent cleaning and maintenance of the optics requires costly and labor-intensive instrument shut-down. The third cone 230 functions to collimate particle trajectory and improve robustness to total dissolved solids (TDS) and protect downstream optics 234 from contamination. By adding an additional skimming interface, more neutrals and other unwanted particles (e.g., TDS) are prevented from entering and contaminating the ion optics 234 and adversely affecting analysis of the sample. The ions are focused by the ion optics 234 through orifice 240 and into vacuum chamber 238 which includes a mass analyzer 236. The mass analyzer is typically a quadrupole mass spectrometer, but may be any other form of mass analyzer, e.g., an ion trap, a magnetic sector analyzer, a time of flight analyzer, an ion mobility analyzer, or any other suitable mass analyzer known to those of skill in the art. The mass analyzer 236 is controlled to produce a mass spectrum for the sample being analyzed.

Figure 3:
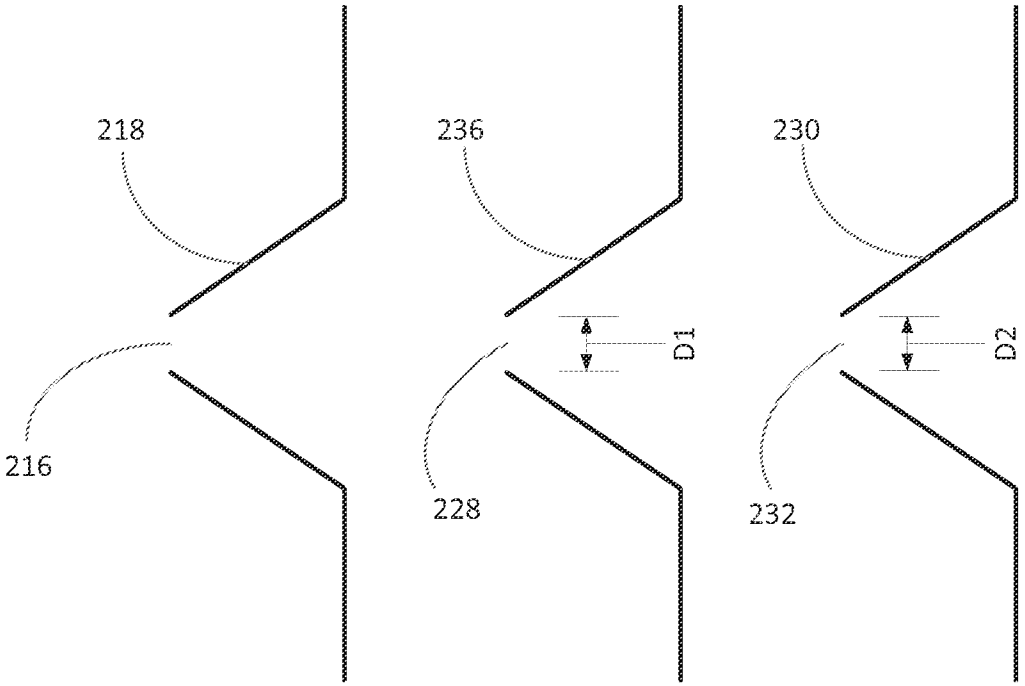
FIG. 3 shows a diagram of the various orifices as in FIG. 2 according to an illustrative embodiment of the invention.

FIG. 3 shows a diagram of the various orifices as in FIG. 2 according to an illustrative embodiment of the invention. As shown in FIG. 3, third cone orifice 232 can be approximately the same size as the skimmer orifice 228. For example, skimmer orifice 228 can be approximately 0.9 mm in diameter (D1), while third cone orifice 232 can be approximately 1 mm in diameter (D2). Accordingly, third cone 230 is configured to allow a flow of ions through third cone orifice 232 in which a majority of the ions expand into the ion optics 234. Because third cone orifice 232 is relatively large, it creates a thin boundary layer, and may serve as a secondary skimmer to further skim the ion beam passing through the orifice 232. Additionally, because the diameter (D2) of the third cone orifice 232 is approximately the same size as the diameter (D1) of the skimmer orifice 228, it prevents clogging of the third cone orifice 232 which would occur with a significantly smaller orifice (clogging is defined herein as the accumulation of solid material on the cone to the degree that the signal intensity falls below the acceptable performance levels). In certain embodiments, the third cone orifice 232 can be slightly larger or smaller than the skimmer orifice 228.

Figure 4:
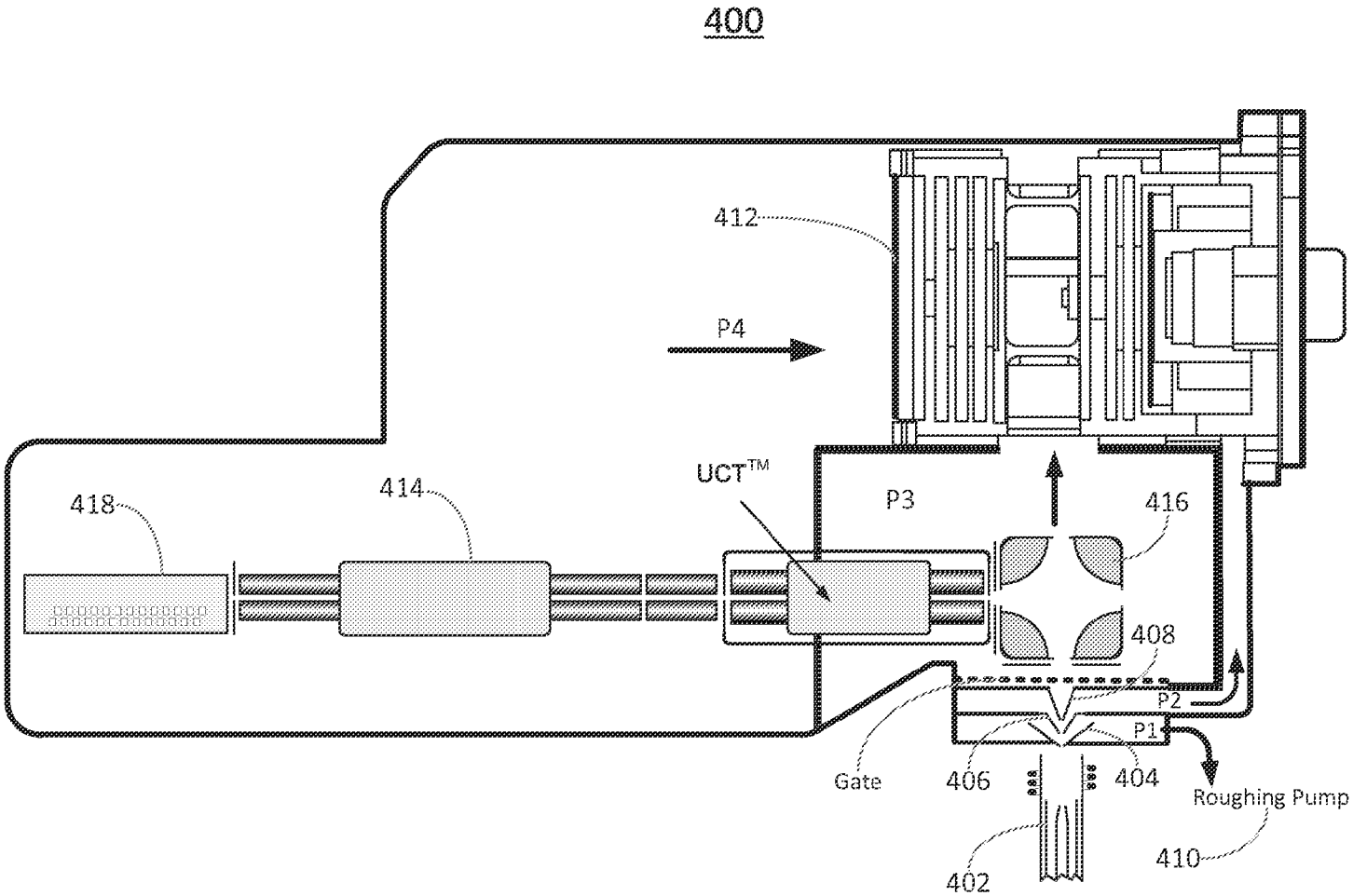
FIG. 4 shows a diagram of an ICP-MS instrument according to an illustrative embodiment of the invention.

FIG. 4 shows an example diagram of an ICP-MS instrument 400 as in the system of FIG. 2, according to an illustrative embodiment of the invention. The ICP-MS instrument 400 includes ICP torch 402, sampler 404, skimmer 406, third cone 408, roughing pump 410, turbo pump 412, quadrupole ion deflector 416, quadrupole mass analyzer 414 and dual-mode detector 418. Similarly to system 200, instrument 400 includes a third cone 408. The region P1 in between the sampler 404 and the skimmer 406 is pumped by a single roughing pump 410, for example, to approximately 1-5 Torr. The region P2 (i.e., commonly referred to as the Holweck stage) between the skimmer 406 and the third cone 408 is pumped by a turbo pump 412, for example, to approximately 20-200 mTorr, and in various aspects, 20-70 mTorr, at approximately 15-25 L/s. The turbo pump 412 is also used to pump region P3 within the quadrupole ion deflector 416 at 300 L/s and region P4, including the mass analyzer, at 400 L/s.

Figure 5:
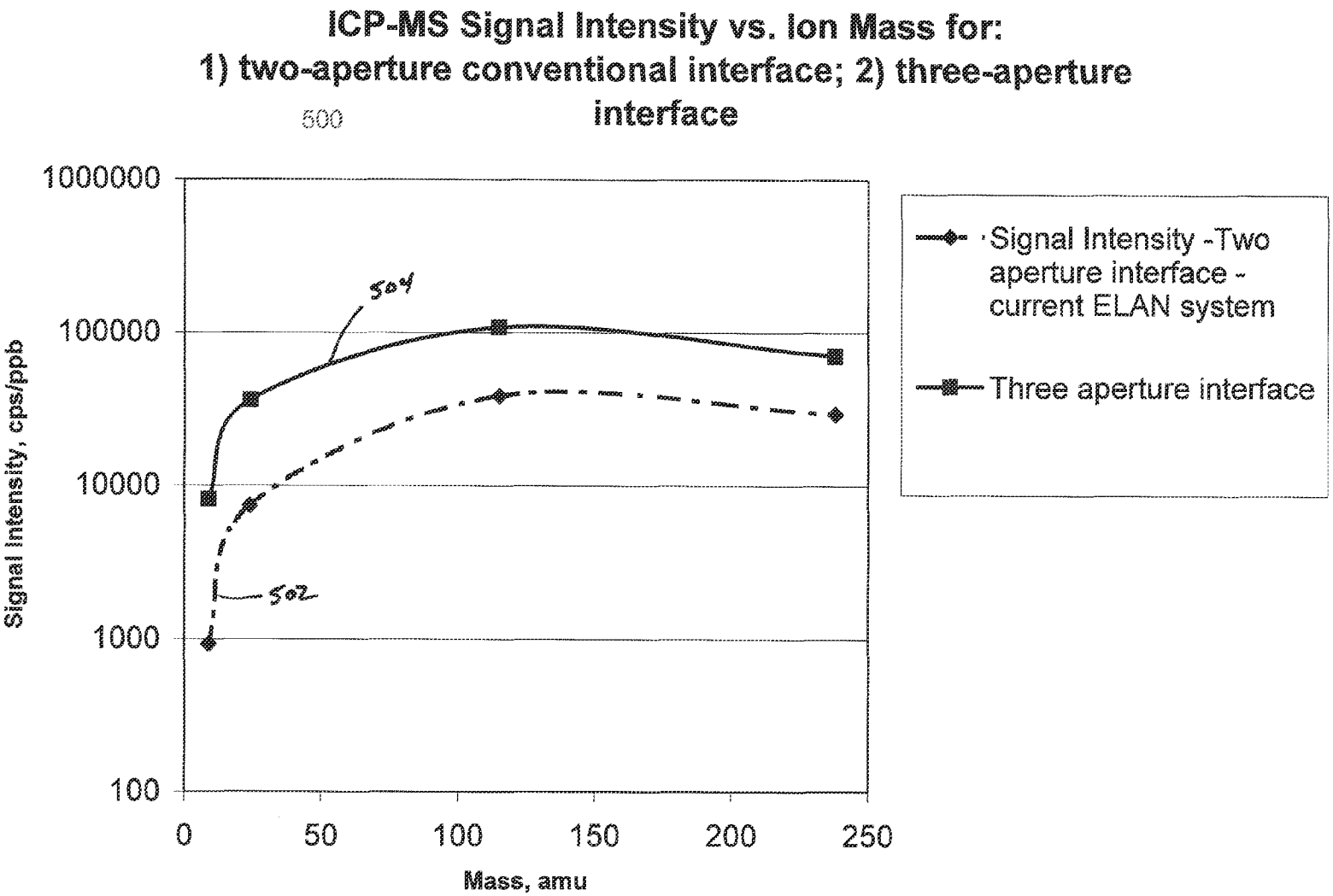
FIG. 5 is a graph showing signal intensity vs. ion mass for a two-aperture interface and a three-aperture interface.

FIG. 5 is a graph 500 showing signal intensity vs. ion mass for a two-aperture interface and a three-aperture interface. In graph 500, plot 502 represents the signal intensity for a two aperture interface with non-extraction ion optics such as the interface described with respect to system 100. Plot 504 represents the signal intensity of a three-aperture interface, such as the interface described with respect to system 400 including a third cone and a quadrupole ion deflector. The combination of the third cone 408 and the quadrupole ion deflector 416 results in approximately a factor of 2-10 improvement of signal intensity across the mass range, as shown in graph 500. As shown in graph 500, the signal enhancement in the low mass range (i.e., 0-50 amu) is more pronounced. Thus, adding a third cone to create a three-aperture interface along with a quadrupole ion deflector, as represented by plot 504, produces a significant increase in signal intensity, particularly in the low mass region, when compared to a 2-aperture system in which a third cone is not used.

Figure 6:
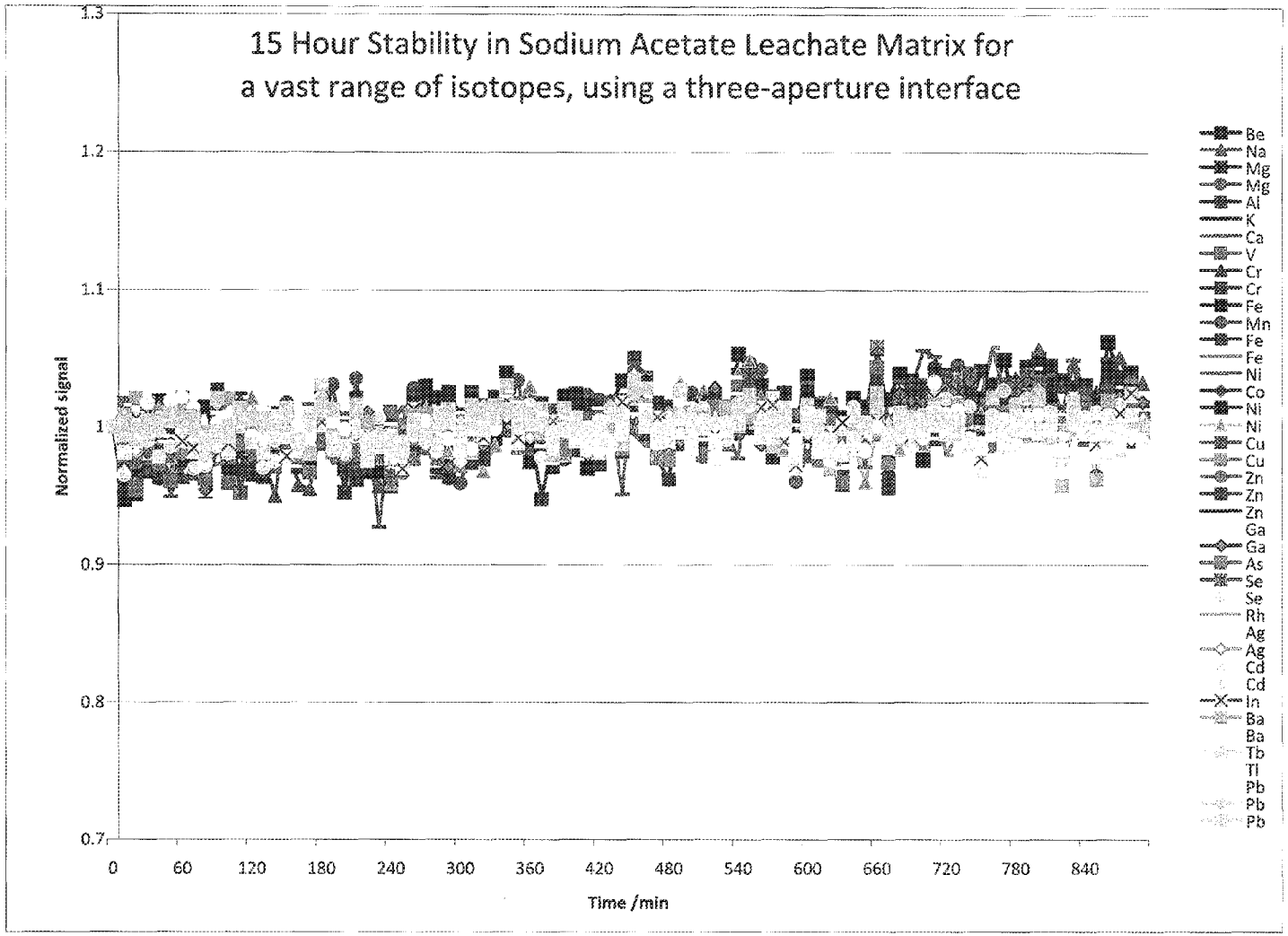
FIG. 6 is a graph showing the stability in a sodium acetate leachate matrix for a range of isotopes using a three-aperture system as in FIG. 2.

FIG. 6 is a graph 600 showing the stability in a 0.1% sodium acetate leaching matrix (known as Toxicity Characteristic Leaching Procedure, TCLP) for a range of isotopes using a three-aperture system, such as system 200. Graph 600 shows the normalized signal intensity vs. time over a 15 hour period for multiple ions. As shown in graph 600, the normalized signal intensity for each ion remains very stable over the entire 15 hour period. Thus, despite the fact that a highly complex matrix such as TCLP is used, the ion optics downstream from the third cone remain clean and do not drift over a long period of time.

Those skilled in the art will know or be able to ascertain using no more than routine experimentation, many equivalents to the embodiments and practices described herein. Accordingly, it will be understood that the invention is not to be limited to the embodiments disclosed herein, but is to be understood from the following claims, which are to be interpreted as broadly as allowed under the law.

What is claimed is:

1. A mass analysis system comprising:

an inductively coupled plasma and a sample introduction system arranged to ionize a portion of a sample into ions, a sampler element including a first orifice arranged to receive the ions into a first vacuum chamber, a first skimmer element having an ungrounded electrical bias and including a second orifice arranged to pass the ions from the first vacuum chamber into a second vacuum chamber, and a second skimmer element including a third orifice arranged to pass the ions from the second vacuum chamber into a third vacuum chamber, the third vacuum chamber including an ion optics assembly for passing the ions to a mass analyzer comprising a quadrupole mass spectrometer, the third orifice being configured to allow a continuum flow of ions to the mass analyzer, wherein the second skimmer element is biased at about ground potential to shield the first skimmer element from downstream extraction fields, wherein the third orifice and second orifice are aligned along a same axis, the diameter of the third orifice being greater than or equal to the diameter of the second orifice.

2. The system of claim 1, wherein the second skimmer element has an angle between its two exterior sides as viewed in a cross-section of at least about 30 degrees.

3. The system of claim 2, wherein the second skimmer element has an angle between its two exterior sides as viewed in a cross-section of about 40 degrees.

4. The system of claim 1, wherein each orifice is substantially circular.

5. The system of claim 1, wherein the second orifice has a first size and the third orifice has a second size, and wherein the first and second size are approximately equal.

6. The system of claim 1, wherein the mass analyzer is selected from a quadrupole assembly, an ion trap, a magnetic sector analyzer, a time of flight analyzer, an ion mobility analyzer, or any combination thereof.

7. The system of claim 1, wherein the ion optics assembly includes at least one ion focusing element.

8. The system of claim 1, wherein the diameter of the third orifice is approximately 1 mm.

9. The system of claim 1, wherein the pressure of the first chamber is approximately 1-5 Torr.

10. The system of claim 1, wherein the pressure of the second chamber is approximately 20-200 mTorr.

11. The system of claim 10, wherein the pressure of the second chamber is approximately 20-70 mTorr.

12. The system of claim 1, wherein the pressure of the third chamber is approximately $1\times10^{-3}$-$1\times10^{-6}$ Torr.

13. The system of claim 1, wherein the second skimmer element is biased at about ground potential to reduce an amount of interference between the downstream extraction fields and the electrical bias of the first skimmer element.

14. A method for analyzing a sample comprising:

introducing a sample, ionizing a portion of the sample into ions, receiving the ions into a first vacuum chamber via a first orifice, receiving the sample ions from the first vacuum chamber into a second vacuum chamber via a second orifice in a first skimmer element that has an ungrounded electrical bias, and receiving the sample ions from the second vacuum chamber into a third vacuum chamber via a third orifice in a second skimmer element, the third vacuum chamber including an ion optics assembly for passing the ions to a mass analyzer comprising a quadrupole mass spectrometer, the third orifice being configured to allow a continuum flow of ions to the mass analyzer, wherein the second skimmer element is biased at about ground potential to shield the first skimmer element from downstream extraction fields, wherein the third orifice and second orifice are aligned along a same axis, the diameter of the third orifice being greater than or equal to the diameter of the second orifice.

15. The method of claim 14, wherein the second skimmer element that has an angle between its two exterior sides as viewed in a cross-section of at least about 30 degrees.

16. The method of claim 15, wherein the second skimmer element has an angle between its two exterior sides as viewed in a cross-section of about 40 degrees.

17. The method of claim 14, wherein each orifice is substantially circular.

18. The method of claim 14, wherein the second orifice has a first size and the third orifice has a second size, and wherein the first and second size are approximately equal.

19. The method of claim 14, wherein the mass analyzer is selected from a quadrupole assembly, an ion trap, a magnetic sector analyzer, a time of flight analyzer, an ion mobility analyzer, or any combination thereof.

20. The method of claim 14, wherein the ion optics assembly includes at least one ion focusing element.

21. The method of claim 14, wherein the diameter of the third orifice is approximately 1 mm.

22. The method of claim 14, further comprising setting the pressure of the first chamber to approximately 1-5 Torr.

23. The method of claim 14, further comprising setting the pressure of the second chamber to approximately 20-200 mTorr.

24. The method of claim 23, further comprising setting the pressure of the second chamber to approximately 20-70 mTorr.

25. The method of claim 14, further comprising setting the pressure of the third chamber to approximately $1\times10^{-3}$-$1\times10^{-6}$ Torr.

26. The method of claim 14, wherein the second skimmer element is biased at about ground potential to reduce an amount of interference between the downstream extraction fields and the electrical bias of the first skimmer element.

* * * * *